US009157184B2

(12) United States Patent
Cantrell

(10) Patent No.: US 9,157,184 B2
(45) Date of Patent: Oct. 13, 2015

(54) INDUSTRIAL ROLL WITH TRIGGERING SYSTEM FOR SENSORS FOR OPERATIONAL PARAMETERS

(71) Applicant: Stowe Woodward Licensco, LLC, Raleigh, NC (US)

(72) Inventor: Clifford Bruce Cantrell, White Post, VA (US)

(73) Assignee: Stowe Woodward Licensco LLC, Youngsville, NC (US)

( * ) Notice: Subject to any disclaimer, the term of this patent is extended or adjusted under 35 U.S.C. 154(b) by 2 days.

(21) Appl. No.: 14/255,734

(22) Filed: Apr. 17, 2014

(65) Prior Publication Data

US 2014/0311364 A1 Oct. 23, 2014

Related U.S. Application Data

(60) Provisional application No. 61/813,767, filed on Apr. 19, 2013.

(51) Int. Cl.

| | |
|---|---|
| ***B30B 15/16*** | (2006.01) |
| ***B30B 15/28*** | (2006.01) |
| ***D21F 3/06*** | (2006.01) |

(Continued)

(52) U.S. Cl.

CPC ... *D21F 3/04* (2013.01); *B30B 3/04* (2013.01); *B30B 15/16* (2013.01); *B30B 15/28* (2013.01); *D21F 3/06* (2013.01); *D21F 3/08* (2013.01); *D21G 9/0036* (2013.01); *D21G 9/0045* (2013.01)

(58) Field of Classification Search

CPC ..... B30B 15/14; B30B 15/16; B30B 13/00; B30B 3/04; B30B 15/28; D21F 3/04; D21F 3/08; D21F 3/06; D21G 9/0045; D21G 9/0036; D21G 1/0233; G01L 5/0085; G01L 5/045; G01L 5/102; G06F 17/00

USPC ..... 100/35, 43, 47, 48, 99; 702/138, 141, 702/151; 492/9, 10; 73/862.55; 29/895, 29/895.2, 895.21, 895.211, 895.3, 895.32

See application file for complete search history.

(56) References Cited

U.S. PATENT DOCUMENTS

| | | | |
|---|---|---|---|
| 5,562,027 | A | 10/1996 | Moore |
| 5,699,729 | A | 12/1997 | Moschel |

(Continued)

FOREIGN PATENT DOCUMENTS

| | | |
|---|---|---|
| JP | 2000193551 | 7/2000 |

OTHER PUBLICATIONS

International Search Report and Written Opinion for corresponding PCT application No. PCT/US2014/034446, 12 pages, date of mailing Jul. 10, 2014.

*Primary Examiner* — Jimmy T Nguyen

(74) *Attorney, Agent, or Firm* — Myers Bigel Sibley & Sajovec, P.A.

(57) ABSTRACT

A method of determining a rotative position of an industrial roll includes: (a) providing a rotating industrial roll having a longitudinal axis, the industrial roll having mounted on one end thereof an accelerometer, the industrial roll further including a plurality of sensors; (b) determining a pre-trigger angular position of the roll based on a first gravity vector provided by the accelerometer; then (c) determining a trigger angular position of the roll based on a second gravity vector provided by the accelerometer, the magnitude of the second gravity vector differing from the magnitude of the first gravity vector by more than the magnitude of a typical noise signal; and (d) gathering data from the sensors after the roll has passed the trigger angular position; and (e) matching the data gathered in step (d) with a respective sensor of the plurality of sensors based on the determination of the trigger angular position.

19 Claims, 4 Drawing Sheets

(51) Int. Cl.

| | |
|---|---|
| ***D21F 3/08*** | (2006.01) |
| ***D21F 3/04*** | (2006.01) |
| ***B30B 3/04*** | (2006.01) |
| ***D21G 9/00*** | (2006.01) |

(56) References Cited

U.S. PATENT DOCUMENTS

| | | | | |
|---|---|---|---|---|
| 6,328,681 | B1 | 12/2001 | Stephens | |
| 6,375,602 | B1 | 4/2002 | Jones | |
| 6,429,421 | B1 | 8/2002 | Meller et al. | |
| 6,568,285 | B1 * | 5/2003 | Moore et al. | 73/862.55 |
| 6,752,908 | B2 * | 6/2004 | Gustafson et al. | 162/358.3 |
| 6,981,935 | B2 | 1/2006 | Gustafson | |
| 2005/0261115 | A1 | 11/2005 | Moore et al. | |
| 2006/0090574 | A1 * | 5/2006 | Moore et al. | 73/862.55 |
| 2006/0248723 | A1 | 11/2006 | Gustafson | |
| 2007/0111871 | A1 | 5/2007 | Butterfield et al. | |
| 2010/0324856 | A1 | 12/2010 | Pak | |
| 2011/0301003 | A1 | 12/2011 | Gustafson | |
| 2013/0185015 | A1 | 7/2013 | Cantrell | |

* cited by examiner

INDUSTRIAL ROLL WITH TRIGGERING SYSTEM FOR SENSORS FOR OPERATIONAL PARAMETERS

RELATED APPLICATION

This application claims the benefit of and priority from U.S. Provisional Patent Application No. 61/813,767, filed Apr. 19, 2013, the disclosure of which is hereby incorporated herein in its entirety.

FIELD OF THE INVENTION

The present invention relates generally to industrial rolls, and more particularly to rolls for papermaking.

BACKGROUND

In a typical papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i. e., the "machine side") of the fabric.

After leaving the forming section, the paper web is transferred to a press section of the paper machine, where it is passed through the nips of one or more presses (often roller presses) covered with another fabric, typically referred to as a "press felt." Pressure from the presses removes additional moisture from the web; the moisture removal is often enhanced by the presence of a "batt" layer of the press felt. The paper is then transferred to a dryer section for further moisture removal. After drying, the paper is ready for secondary processing and packaging.

Cylindrical rolls are typically utilized in different sections of a papermaking machine, such as the press section. Such rolls reside and operate in demanding environments in which they can be exposed to high dynamic loads and temperatures and aggressive or corrosive chemical agents. As an example, in a typical paper mill, rolls are used not only for transporting the fibrous web sheet between processing stations, but also, in the case of press section and calender rolls, for processing the web sheet itself into paper.

Typically rolls used in papermaking are constructed with the location within the papermaking machine in mind, as rolls residing in different positions within the papermaking machines are required to perform different functions. Because papermaking rolls can have many different performance demands, and because replacing an entire metallic roll can be quite expensive, many papermaking rolls include a polymeric cover that surrounds the circumferential surface of a typically metallic core. By varying the material employed in the cover, the cover designer can provide the roll with different performance characteristics as the papermaking application demands. Also, repairing, regrinding or replacing a cover over a metallic roll can be considerably less expensive than the replacement of an entire metallic roll. Exemplary polymeric materials for covers include natural rubber, synthetic rubbers such as neoprene, styrene-butadiene (SBR), nitrile rubber, chlorosulfonated polyethylene ("CSPE"—also known under the trade name HYPALON from DuPont), EDPM (the name given to an ethylene-propylene terpolymer formed of ethylene-propylene diene monomer), polyurethane, thermoset composites, and thermoplastic composites.

In many instances, the roll cover will include at least two distinct layers: a base layer that overlies the core and provides a bond thereto; and a topstock layer that overlies and bonds to the base layer and serves the outer surface of the roll (some rolls will also include an intermediate "tie-in" layer sandwiched by the base and top stock layers). The layers for these materials are typically selected to provide the cover with a prescribed set of physical properties for operation. These can include the requisite strength, elastic modulus, and resistance to elevated temperature, water and harsh chemicals to withstand the papermaking environment. In addition, covers are typically designed to have a predetermined surface hardness that is appropriate for the process they are to perform, and they typically require that the paper sheet "release" from the cover without damage to the paper sheet. Also, in order to be economical, the cover should be abrasion- and wear-resistant.

As the paper web is conveyed through a papermaking machine, it can be very important to understand the pressure profile experienced by the paper web. Variations in pressure can impact the amount of water drained from the web, which can affect the ultimate sheet moisture content, thickness, and other properties. The magnitude of pressure applied with a roll can, therefore, impact the quality of paper produced with the paper machine.

Other properties of a roll can also be important. For example, the stress and strain experienced by the roll cover in the cross machine direction can provide information about the durability and dimensional stability of the cover. In addition, the temperature profile of the roll can assist in identifying potential problem areas of the cover.

It is known to include pressure and/or temperature sensors in the cover of an industrial roll. For example, U.S. Pat. No. 5,699,729 to Moschel et al. describes a roll with a helically-disposed leads that includes a plurality of pressure sensors embedded in the polymeric cover of the roll. The sensors are helically disposed in order to provide pressure readings at different axial locations along the length of the roll. Typically the sensors are connected by a signal carrying member that transmits sensor signals to a processor that processes the signals and provides pressure and position information.

SUMMARY OF THE INVENTION

As a first aspect, embodiments of the invention are directed to a method of determining the rotative position of an industrial roll. The method comprises the steps of:

(a) providing a rotating industrial roll having a longitudinal axis, the industrial roll having mounted on one end thereof an accelerometer;

(b) detecting a gravity vector generated in the accelerometer;

(c) comparing the magnitude and direction of the gravity vector detected in step (b) to a predetermined pre-trigger gravity vector;

(d) if the absolute value of the gravity vector detected in (b) has not reached the absolute value of the pre-trigger gravity vector, repeating steps (b) and (c); otherwise, proceeding to step (e);

(e) detecting the gravity vector generated in the accelerometer;

(f) comparing the magnitude and direction detected in (e) to a predetermined trigger gravity vector, the absolute value of the magnitude of the trigger gravity vector differing from the absolute value of the magnitude of the pre-trigger gravity vector by an amount greater than a typical noise signal generated by the accelerometer;

(g) if the absolute value of the magnitude of the gravity vector detected in step (f) reaches the absolute value of the magnitude of the trigger gravity vector, repeating steps (e) and (f); otherwise, proceeding to step (h); and (h) determining the rotative position of the roll based on the gravity vector detected in step (e).

As a second aspect, embodiments of the invention are directed to a method of determining the rotative position of an industrial roll, the method comprising the steps of:

(a) providing a rotating industrial roll having a longitudinal axis, the industrial roll having mounted on one end thereof an accelerometer, the industrial roll further including a plurality of sensors, each of the sensors configured to detect an operational parameter;

(b) determining a pre-trigger angular position of the roll based on a first gravity vector provided by the accelerometer; then (c) determining a trigger angular position of the roll based on a second gravity vector provided by the accelerometer, the magnitude of the second gravity vector differing from the magnitude of the first gravity vector by more than the magnitude of a typical noise signal; and (d) gathering data from the sensors after the roll has passed the trigger angular position; and (e) matching the data gathered in step (d) with a respective sensor of the plurality of sensors based on the determination of the trigger angular position.

As a third aspect, embodiments of the invention are directed to a system for determining the rotative position of an industrial roll, comprising: an industrial roll having a longitudinal axis; an accelerometer mounted on one end of the industrial roll; a plurality of sensors mounted on the roll, each of the sensors configured to detect an operational parameter; and a processor associated with the plurality of sensors and with the accelerometer. The processor is configured to:

(a) determine a pre-trigger angular position of the roll based on a first gravity vector provided by the accelerometer; then (b) determine a trigger angular position of the roll based on a second gravity vector provided by the accelerometer, the magnitude of the second gravity vector differing from the magnitude of the first gravity vector by more than the magnitude of a typical noise signal; and (c) gather data from the sensors after the roll has passed the trigger angular position; and (d) match the data gathered in step (c) with a respective sensor of the plurality of sensors based on the determination of the trigger angular position.

DETAILED DESCRIPTION OF EMBODIMENTS OF THE INVENTION

Figure 1:
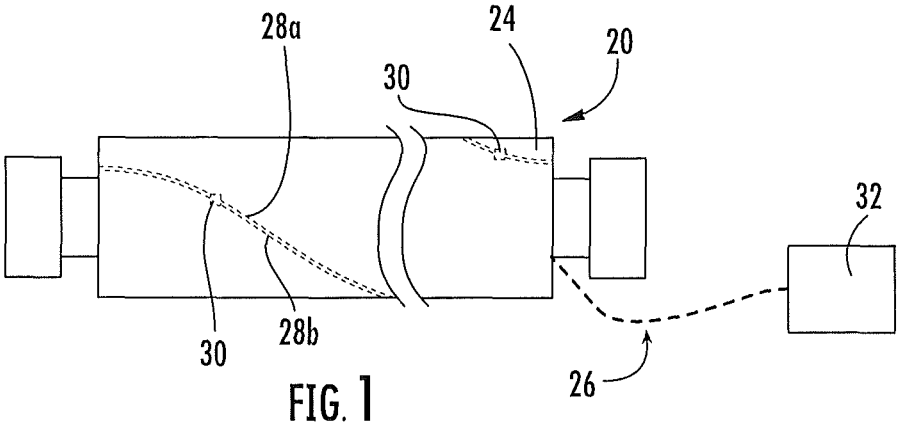
FIG. 1 is a front view of an industrial roll with sensors for detecting operational parameters according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. As used herein, the term "and/or" includes any and all combinations of one or more of the associated listed items. Where used, the terms "attached," "connected," "interconnected," "contacting," "coupled," "mounted," "overlying" and the like can mean either direct or indirect attachment or contact between elements, unless stated otherwise.

The present invention is described below with reference to block diagrams and/or flowchart illustrations of methods, apparatus (systems) and/or computer program products according to embodiments of the invention. It is understood that each block of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, circuit, and/or other programmable data processing apparatus to produce a machine, such that the instructions, which execute via the processor of the computer and/or other programmable data processing apparatus, create means for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, the present invention may be embodied in hardware and/or in software (including firmware, resident software, micro-code, etc.). Furthermore, embodiments of the present invention may take the form of a computer program product on a computer-usable or computer-readable non-transient storage medium having computer-usable or computer-readable program code embodied in the medium for use by or in connection with an instruction execution system.

The computer-usable or computer-readable medium may be a non-transient computer-readable medium, for example but not limited to, an electronic, electromagnetic, or semiconductor system, apparatus, or device. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), and a portable compact disc read-only memory (CD-ROM).

Referring now to FIG. 1, an industrial roll, designated broadly at 20, is illustrated in FIG. 1. The roll 20 has a longitudinal axis A and includes a hollow cylindrical shell or core 22 (not shown in FIG. 1) and a cover 24 (typically formed of one or more polymeric materials) that encircles the core 22. A sensing system 26 for sensing pressure includes a pair of electrical leads 28*a*, 28*b* and a plurality of pressure sensors 30, each of which is embedded in the cover 24. As used herein, a sensor being "embedded" in the cover means that the sensor is either entirely contained within the cover, and a sensor being "embedded" in a particular layer or set of layers of the cover means that the sensor is entirely contained within that layer or set of layers. The sensing system 26 also includes a processor 32 that processes signals produced by the piezoelectric sensors 30.

The core is typically formed of a metallic material, such as steel or cast iron. The core can be solid or hollow, and if hollow may include devices that can vary pressure or roll profile.

The cover 24 can take any form and can be formed of any polymeric and/or elastomeric material recognized by those skilled in this art to be suitable for use with a roll. Exemplary materials include natural rubber, synthetic rubbers such as neoprene, styrene-butadiene (SBR), nitrile rubber, chlorosulfonated polyethylene ("CSPE"—also known under the trade name HYPALON), EDPM (the name given to an ethylene-propylene terpolymer formed of ethylene-propylene diene monomer), epoxy, and polyurethane. The cover 24 may also include reinforcing and filler materials, additives, and the like. Exemplary additional materials are discussed in U.S. Pat. No. 6,328,681 to Stephens, U.S. Pat. No. 6,375,602 to Jones, and U.S. Pat. No. 6,981,935 to Gustafson, and in U.S. Patent Publication No. 2007/0111871 to Butterfield, the disclosures of each of which are hereby incorporated herein in their entireties.

In many instances, the cover 24 will comprise multiple layers. The construction of an exemplary roll with multiple layers is described in U.S. Pat. No. 8,346,501 to Pak and U.S. Patent Publication No. 2005/0261115 to Moore, the disclosures of which are hereby incorporated herein in their entirety.

Referring again to FIG. 1, the sensors 30 of the sensing system 26 can take any shape or form recognized by those skilled in this art as being suitable for detecting pressure, including piezoelectric sensors, optical sensors and the like. Exemplary sensors are discussed in U.S. Pat. No. 5,699,729 to Moschel et al.; U.S. Pat. No. 5,562,027 to Moore; U.S. Pat. No. 6,981,935 to Gustafson; and U.S. Pat. No. 6,429,421 to Meller; and U.S. Patent Publication Nos. 2005/0261115 to Moore and 2006/0248723 to Gustafson, the disclosures of each of which are incorporated herein by reference. Piezoelectric sensors can include any device that exhibits piezoelectricity when undergoing changes in pressure, temperature or other physical parameters. "Piezoelectricity" is defined as the generation of electricity or of electrical polarity in dielectric crystals subjected to mechanical or other stress, the magnitude of such electricity or electrical polarity being sufficient to distinguish it from electrical noise. Exemplary piezoelectric sensors include piezoelectric sensors formed of piezoelectric ceramic, such as PZT-type lead-zirgonate-titanate, quartz, synthetic quartz, tourmaline, gallium ortho-phosphate, CGG ($Ca_3Ga_2Ge_4O_{14}$), lithium niobate, lithium tantalite, Rochelle salt, and lithium sulfate-monohydrate. In particular, the sensor material can have a Curie temperature of above 350° F., and in some instances 600° F., which can enable accurate sensing at the temperatures often experienced by rolls in papermaking environments. A typical outer dimension of the sensor 30 (i.e., length, width, diameter, etc.) is between about 2 mm and 20 mm, and a typical thickness of the sensor 30 is between about 0.002 and 0.2 inch.

In the illustrated embodiment, the sensors 30 are tile-shaped, i.e., square and flat; however, other shapes of sensors and/or apertures may also be suitable. For example, the sensors 30 themselves may be rectangular, circular, annular, triangular, oval, hexagonal, octagonal, or the like. Also, the sensors 30 may be solid, or may include an internal or external aperture, (i.e., the aperture may have a closed perimeter, or the aperture may be open-ended, such that the sensor 30 takes a "U" or "C" shape). See, e.g., U.S. Patent Publication No. 2006/0248723 to Gustafson, the disclosure of which is hereby incorporated herein in its entirety.

The sensors 30 are arranged in a helix having a longitudinal axis that is substantially coincident with the longitudinal axis A of the roll 10. In the illustrated embodiment, the sensors 30 define most of a single helical coil, but in other embodiments the sensors 30 may define a multiple coils, or may define less than a single coil. Also, in some embodiments multiple sets or strings of sensors 30 may be employed.

It is also noteworthy that the sensors 30 may be configured to detect an operational parameter other than pressure (for example, temperature or moisture) and still be suitable for use in embodiments of the invention.

Figure 2:
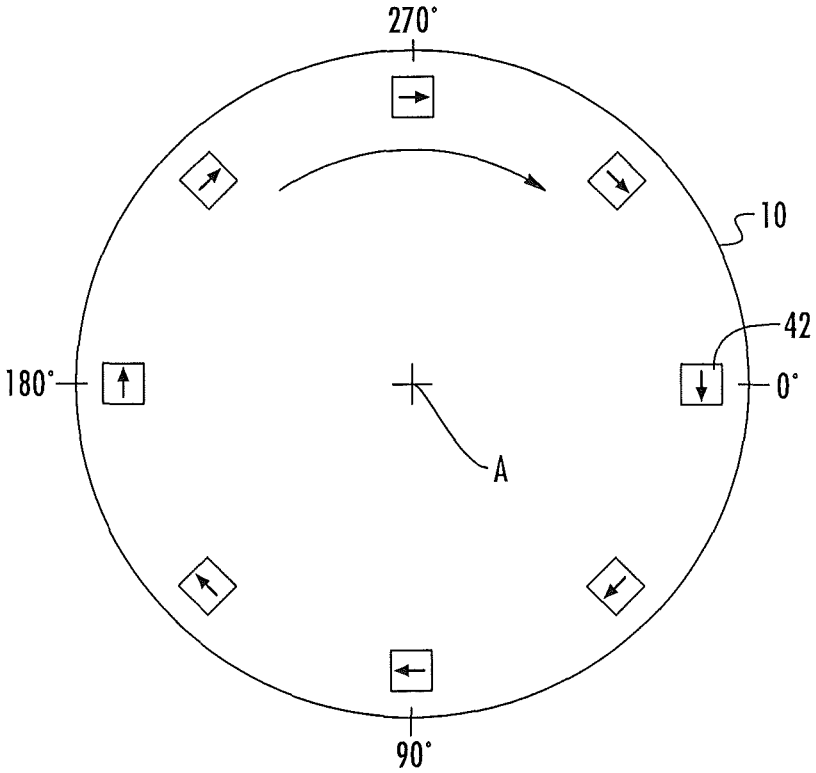
FIG. 2 is an end view of an industrial roll having an accelerometer mounted thereon, schematically showing the measured force vector of the accelerometer at different roll positions.

When sensors are mounted onto a rotating roll as described above, it may become necessary to trigger data gathering or some other activity at a specific point in each rotation. As shown in FIG. 2, industrial rolls may include an accelerometer 42 mounted to the end of the roll 10 to assist in determining the position of the roll 10. The accelerometer 42 may be of conventional construction. The accelerometer 42, which may be of typical construction, is configured to detect the magnitude and direction of the acceleration of a moving object with respect to gravity, and can generate a gravity vector based on the magnitude and direction of the acceleration.

With the accelerometer 42 mounted tangentially to the longitudinal axis of the roll 10, as the roll 10 turns about its longitudinal axis A, the gravity vector induced by the rotation of the roll 10 changes based on its angular position. Referring to FIG. 2, when the accelerometer 42 is at the 3 o'clock position (shown as 0 degrees in FIG. 2) the gravity vector points down and has a magnitude of 1 G. When the accelerometer 42 is at the 6 o'clock position (shown as 90 degrees in FIG. 2), the accelerometer 42 reads zero because the gravity vector is orthogonal to the accelerometer vector. When the accelerometer 42 is at the 9 o'clock position (shown as 180 degrees in FIG. 2), the accelerometer 42 reads −1 G, and at 12 o'clock (shown as 270 degrees in FIG. 2) it reads zero. Because the accelerometer 42 is mounted tangentially to the longitudinal axis A, any centrifugal forces generated therein by the rotation are not a significant factor. As used herein, the designation "G" refers to the acceleration (both in magnitude and direction) detected by the accelerometer 42; those of skill in this art will understand that accelerometer data measures acceleration (measured in units of length/time$^2$), and that "G" is a shorthand for such acceleration, with "1 G" being the acceleration produced by the earth's gravitational field. For a rotating roll with an accelerometer mounted on the end of the roll circumferentially to the axis of rotation, "1 G" is the maximum acceleration measured and "−1 G" is the minimum acceleration (i.e., the acceleration in the direction opposite to that of the "1 G" measurement).

Figure 3:
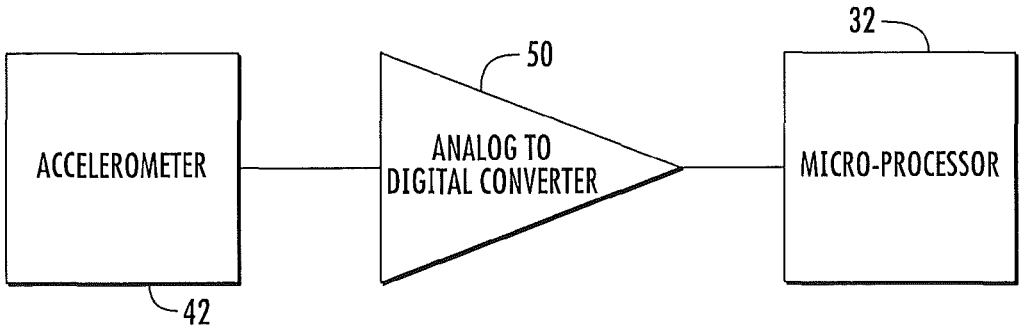
FIG. 3 is a schematic view of a position-determining system according to embodiments of the invention.
Figure 4A:
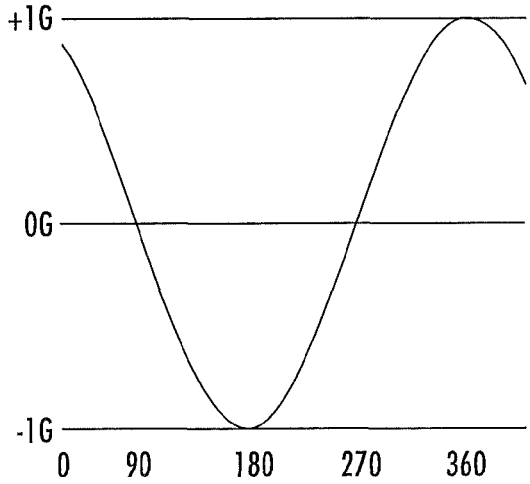
FIG. 4A is a graph plotting accelerometer force as a function of roll position.

FIG. 3 schematically illustrates electronics that can be used to monitor the signal produced by the accelerometer 42. An analog to digital converter 50 can be used to convert the signal from a voltage to a digital data stream, which is then provided to the processor 32. Because the roll 10 is rotating in a circular fashion, the accelerometer signal data follows the rotating gravity vector and is sinusoidal in shape. FIG. 4A displays a curve of a sample accelerometer output from a rotating roll, with force (including magnitude and direction) experienced by the accelerometer 42 plotted as a function of roll angle.

In prior embodiments, reliable detection of a trigger point generated by an accelerometer has been difficult due to the presence of noise (typically caused by roll vibration) in the accelerometer data signal, which can be sufficient to cause the signal to "trigger" at the wrong time. For example, if the trigger point were designated as the horizontal axis (i.e., the "0" line of the graph of FIG. 4A, which would correspond to the "3 o'clock" or "0 degree" position of FIG. 2) as the curve moves upward (which would correspond to the "6 o'clock" or "90 degree" position of FIG. 2), the system 26 would understand that any accelerometer signal that crossed the horizontal axis would be the trigger point for that location on the roll 10. If noise in the data signal caused the signal to dip back down below the horizontal axis, then jump immediately above the horizontal axis again, the system would erroneously interpret the second upward crossing of the horizontal axis as the beginning of another roll rotation rather than understanding it as the presence of noise in the signal. Such an erroneous interpretation would then provide incorrect matching of sensor data to roll position.

Figure 4B:
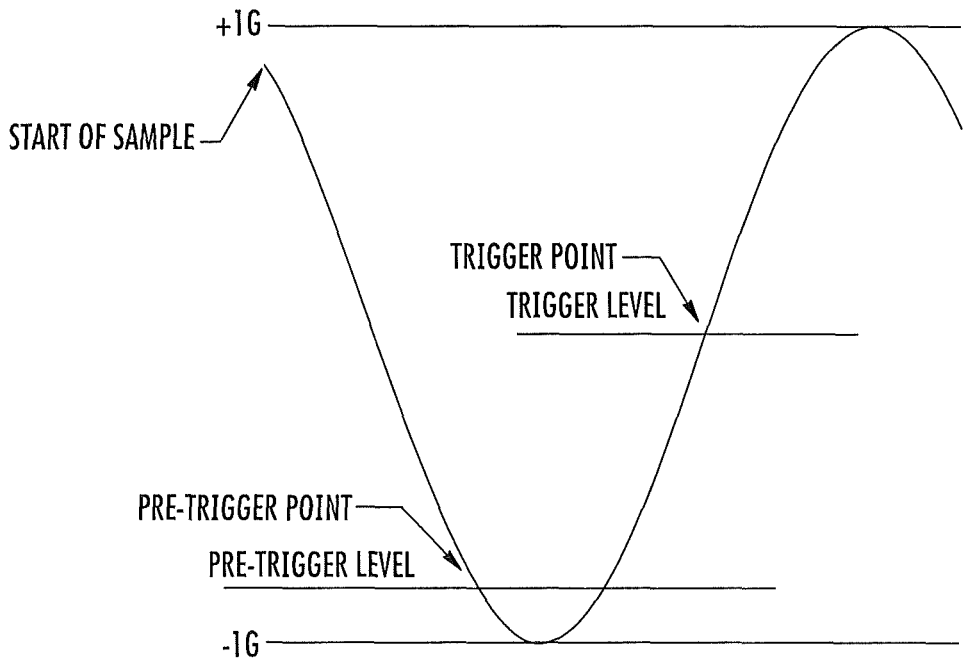
FIG. 4B is a graph plotting accelerometer force as a function of roll position, wherein exemplary pre-trigger and trigger values are shown according to embodiments of the invention.
Figure 5:
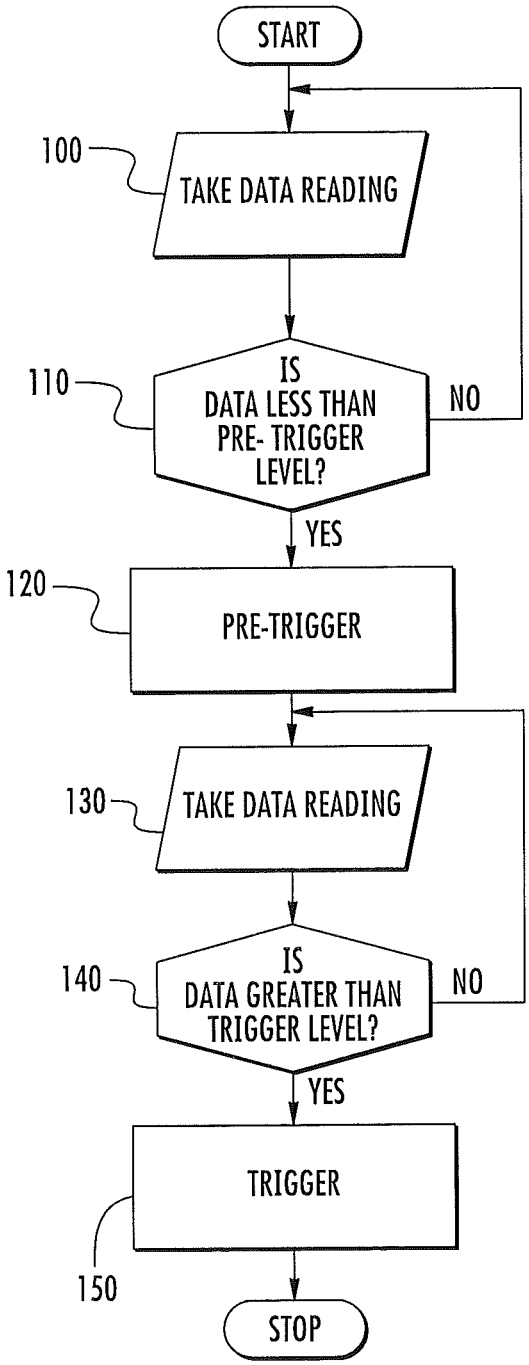
FIG. 5 is a flow diagram of operations according to embodiments of the invention.

The algorithm illustrated in FIG. 5 can address this issue. As shown in FIG. 5, a first sample from the accelerometer is taken as an initial step (block 100). The system determines whether the magnitude of the absolute value of the gravity vector produced based on the accelerometer sample data is less than a predetermined pre-trigger level (block 110—see also FIG. 4B). The pre-trigger level is typically set to differ significantly from the trigger level, at a level that is beyond the typical noise error of the system. Note also that the pre-trigger level corresponds to a pre-trigger angular position that differs significantly from that of the trigger level. If the absolute value of the magnitude of the gravity vector is below the pre-trigger level (i.e., the signal has not reached the pre-trigger level), the loop continues. At some point the magnitude of the absolute value of the gravity vector of the accelerator sample data reaches and rises above the pre-trigger threshold (block 120 and FIG. 4B). Samples continue to be taken (block 130), but the absolute value of the gravity vector is then compared to that of the trigger level (block 140), which in the illustrated example is located at the horizontal axis. Again, the magnitude of the trigger level differs significantly from that of the pre-trigger level (typically about 0.1 to 0.9 G, and in some embodiments 0.3 G, 0.4 G or 0.50 to 0.7 G, 0.8 G or 0.9 G); also, the angular position corresponding to the trigger level differs significantly from that of the pre-trigger level (typically about 10 to 120 degrees, and in some embodiments 30, 40 or 50 degrees to 90, 100 or 120 degrees). Because initially the magnitude of the gravity vector of the accelerometer data has not reached the trigger level, sampling continues in the trigger loop until the magnitude of the gravity vector of the accelerometer signal reaches the trigger level (block 150 and FIG. 4B). At this point a trigger has occurred, and sensor data can be gathered and matched with their corresponding sensors/angular positions on the roll.

With this technique, the position of the roll 10 can be found reliably, because the system 26 will trigger at essentially the same point in the cycle repeatedly. Thus, the trigger can be used to identify the angular position of the roll, which enables the determination of which sensors 30 strung around the roll 10 have provided which data points in a data set. The use of significantly different pre-trigger and trigger levels can ensure that the accelerometer 42 is in its desired position (e.g., at the bottom of the rotation for the example shown in FIG. 2) for the initiation of data collection, even when some noise is present in the accelerometer data as the roll rotates. This capability can be especially useful in a system configuration reading multiple events per rotation (for example, if a roll is mated with multiple mating structures, such that the roll forms multiple nips).

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A method of determining a rotative position of an industrial roll, comprising the steps of:

(a) providing a rotating industrial roll having a longitudinal axis, the industrial roll having mounted on one end thereof an accelerometer;

(b) detecting a gravity vector generated in the accelerometer;

(c) comparing a magnitude and direction of the gravity vector detected in step (b) to a predetermined pre-trigger gravity vector;

(d) if an absolute value of the gravity vector detected in (b) has not reached an absolute value of the pre-trigger gravity vector, repeating steps (b) and (c); otherwise, proceeding to step (e);

(e) detecting the gravity vector generated in the accelerometer;

(f) comparing the magnitude and direction of the gravity vector detected in (e) to a predetermined trigger gravity vector, the absolute value of the magnitude of the trigger gravity vector differing from the absolute value of the magnitude of the pre-trigger gravity vector by an amount greater than a typical noise signal generated by the accelerometer;

(g) if the absolute value of the magnitude of the gravity vector detected in step (f) reaches the absolute value of the magnitude of the trigger gravity vector, repeating steps (e) and (f); otherwise, proceeding to step (h); and (h) determining the rotative position of the roll based on the gravity vector detected in step (e).

2. The method defined in claim 1, wherein the industrial roll includes a plurality of sensors, each of the sensors configured to detect an operational parameter, and wherein positions of the sensors on the roll is determined based on the rotative position of the roll determined in step (h).

3. The method defined in claim 2, wherein a sensors are arranged in a helix having an axis that is coincident with the longitudinal axis of the roll.

4. The method defined in claim 3, wherein the sensors are configured to detect pressure.

5. The method defined in claim 2, wherein the industrial roll includes a polymeric cover, and wherein the sensors are at least partially embedded in the cover.

6. The method defined in claim 1, wherein the difference in magnitude between the pre-trigger gravity vector and the trigger gravity vector is between about 0.1 G and 0.9 G.

7. The method defined in claim 1, wherein the angular position of the roll denoted by the pre-trigger gravity vector and the angular position denoted by the trigger gravity vector are separated by 10 to 120 degrees.

8. A method of determining the rotative position of an industrial roll, comprising the steps of:

(a) providing a rotating industrial roll having a longitudinal axis, the industrial roll having mounted on one end thereof an accelerometer, the industrial roll further including a plurality of sensors, each of the sensors configured to detect an operational parameter;

(b) determining a pre-trigger angular position of the roll based on a first gravity vector provided by the accelerometer; then (c) determining a trigger angular position of the roll based on a second gravity vector provided by the accelerometer, the magnitude of the second gravity vector differing from the magnitude of the first gravity vector by more than the magnitude of a typical noise signal; and (d) gathering data from the sensors after the roll has passed the trigger angular position; and (e) matching the data gathered in step (d) with a respective sensor of the plurality of sensors based on the determination of the trigger angular position.

9. The method defined in claim 8, wherein the sensors are arranged in a helix having an axis that is coincident with the longitudinal axis of the roll.

10. The method defined in claim 9, wherein the sensors are configured to detect pressure.

11. The method defined in claim 8, wherein the industrial roll includes a polymeric cover, and wherein the sensors are at least partially embedded in the cover.

12. The method defined in claim 8, wherein the difference in magnitude between the pre-trigger gravity vector and the trigger gravity vector is between about 0.3 G and 0.9 G.

13. The method defined in claim 8, wherein the difference in angular rotation associated with the pre-trigger angular position and the trigger angular position is between about 30 and 120 degrees.

14. A system for determining a rotative position of an industrial roll, comprising:

an industrial roll having a longitudinal axis;

an accelerometer mounted on one end of the industrial roll;

a plurality of sensors mounted on the roll, each of the sensors configured to detect an operational parameter; and a processor associated with the plurality of sensors and with the accelerometer, wherein the processor is configured to:

(a) determine a pre-trigger angular position of the roll based on a first gravity vector provided by the accelerometer; then (b) determine a trigger angular position of the roll based on a second gravity vector provided by the accelerometer, the magnitude of the second gravity vector differing from the magnitude of the first gravity vector by more than the magnitude of a typical noise signal;

(c) gather data from the sensors after the roll has passed the trigger angular position; and (d) match the data gathered in step (c) with a respective sensor of the plurality of sensors based on the determination of the trigger angular position.

15. The system defined in claim 14, wherein the sensors are arranged in a helix having an axis that is coincident with the longitudinal axis of the roll.

16. The system defined in claim 14, wherein the sensors are configured to detect pressure.

17. The system defined in claim 14, wherein the industrial roll includes a polymeric cover, and wherein the sensors are at least partially embedded in the cover.

18. The system defined in claim 14, wherein the difference in magnitude between the pre-trigger gravity vector and the trigger gravity vector is between about 0.4 G and 0.8 G.

19. The system defined in claim 14, wherein the difference in angular rotation associated with the pre-trigger angular position and the trigger angular position is between about 50 and 110 degrees.

* * * * *

UNITED STATES PATENT AND TRADEMARK OFFICE

CERTIFICATE OF CORRECTION

PATENT NO. : 9,157,184 B2
APPLICATION NO. : 14/255734
DATED : October 13, 2015
INVENTOR(S) : Cantrell It is certified that error appears in the above-identified patent and that said Letters Patent is hereby corrected as shown below:

In the Claims:

Column 9, Claim 3, Line 12: Please correct "wherein a sensors are"
to read -- wherein the sensors are --

Signed and Sealed this
Fifth Day of April, 2016

Michelle K. Lee

Michelle K. Lee
*Director of the United States Patent and Trademark Office*